United States Patent [19]

Aso

[11] Patent Number: 4,526,436

[45] Date of Patent: Jul. 2, 1985

[54] ELECTRICAL CONNECTOR FOR FLAT FLEXIBLE CABLE

[75] Inventor: Akira Aso, Lisle, Ill.

[73] Assignee: Molex Incorporated, Lisle, Ill.

[21] Appl. No.: 558,138

[22] Filed: Dec. 5, 1983

[30] Foreign Application Priority Data

Dec. 10, 1982 [JP] Japan ..... 57-215435

[51] Int. Cl.[3] ..... H01R 9/07

[52] U.S. Cl. ..... 339/176 MF; 339/17 F; 339/176 MP

[58] Field of Search ..... 339/17 F, 176 MF, 176 MP, 339/217 S, 258 R

[56] References Cited

U.S. PATENT DOCUMENTS

| | | | |
|---|---|---|---|
| Re. 26,692 | 10/1969 | Ruehlemann | 339/176 MP |
| 3,233,208 | 2/1966 | Ruehlemann et al. | 339/176 MP |
| 3,720,907 | 3/1973 | Asick | 339/176 MP |

FOREIGN PATENT DOCUMENTS

| | | | |
|---|---|---|---|
| 2459307 | 6/1976 | France | 339/176 MP |
| 1046859 | 10/1966 | United Kingdom | 339/258 R |
| 1570189 | 6/1980 | United Kingdom | 339/176 MP |

*Primary Examiner*—John McQuade

*Attorney, Agent, or Firm*—Louis A. Hecht; Bruce R. Mansfield

[57] ABSTRACT

A connector assembly for electrically connecting the conductors of a flat flexible multi-conductor cable to another circuit member. The connector assembly includes a housing having the plurality of side by side, elongated open-ended terminal receiving cavities and a plurality of stamped U-shaped terminals received in the cavities. Each terminal has first and second arms extending up from the base of the body with a contact portion formed near the free end of one of the arms for making electrical contact with the cable conductor when the cable is received in the housing slot in the area between the two arms. The first arm includes a hooked-shaped engaging portion having the contact surface formed thereon that is disposed substantially vertical to and in projecting relation from the plane of the first arm at an acute angle relative to the longitudinal axis thereof. The second arm has a lateral flange portion extending substantially the whole length of the second arm and projecting at a right angle with respect to the plane of the second arm. Each terminal receiving cavity includes a terminal support portion defining a L-shaped slot immediately adjacent to and transverse to the cable receiving slot. A flange portion is adapted to be received on one side of the terminals supporting portion and the hooked-shaped engaging portion has it contact surface biased against the other side of the contact supporting portion. The cable conductor is adapted to be received in the slot so that it is disposed between the contact surface and the contact supporting portion.

7 Claims, 15 Drawing Figures

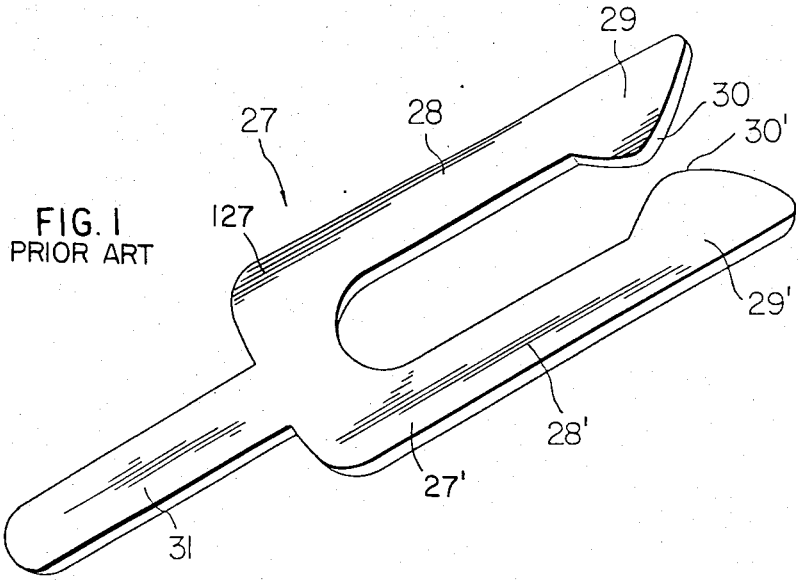
FIG. 1
PRIOR ART
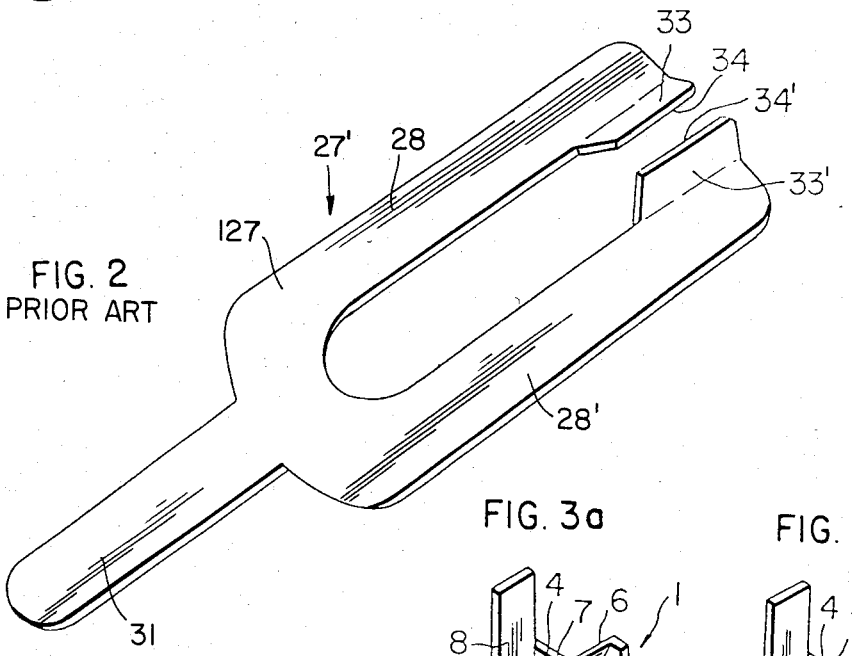
FIG. 2
PRIOR ART
FIG. 3a
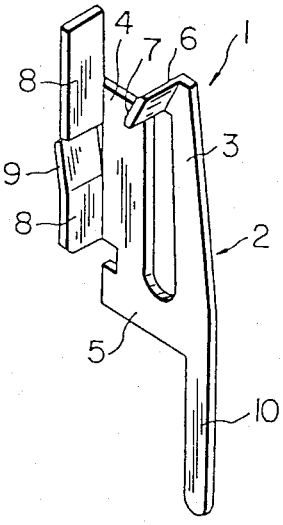
FIG. 3b
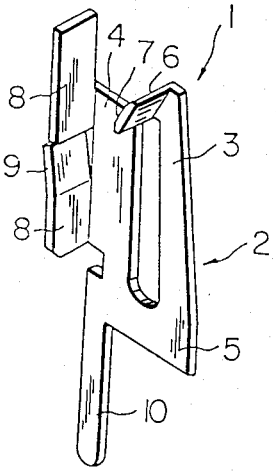

FIG. 5b
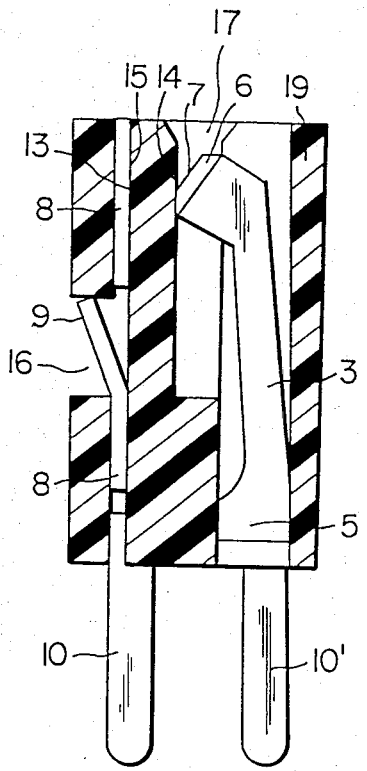
FIG. 6
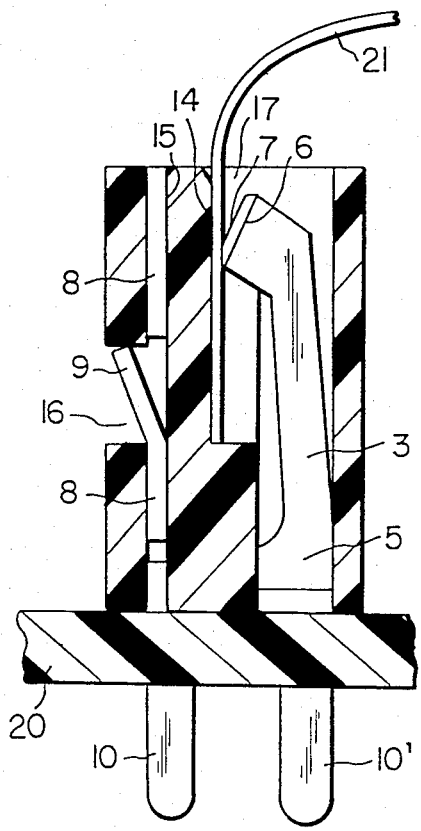
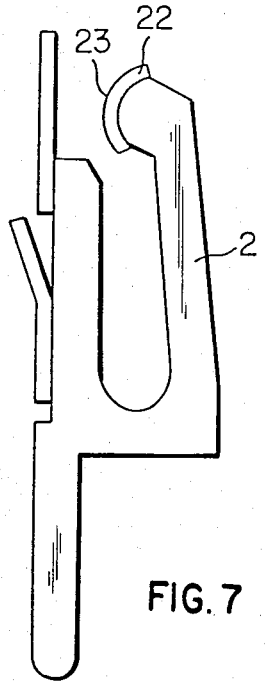
FIG. 7
FIG. 8a
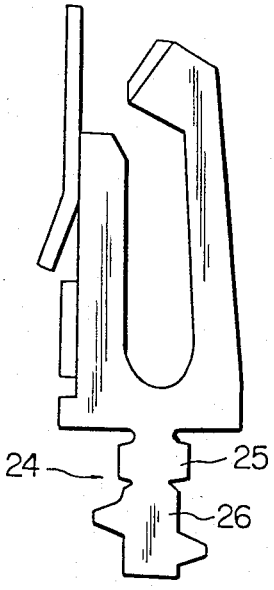
FIG. 8b
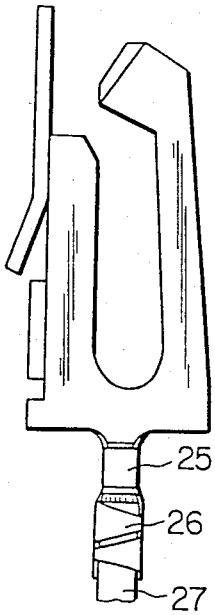

ELECTRICAL CONNECTOR FOR FLAT FLEXIBLE CABLE

BACKGROUND OF THE INVENTION

1. Field of the Invention

The present invention relates to a new and improved electrical connector which is adapted to electrically connect a flat flexible cable to another circuit element.

2. Brief Description of the Prior Art

With the advent of high technology and computer related applications, space has become a premium when designing and building electrical apparatus. One means of overcoming these space limitations, is the use of multi-conductor flat flexible cable.

In order to connect a flat flexible cable to another circuit member, the insulation is stripped exposing a plurality of flat conductors which are adapted to be mated with an electrical connector assembly. The electrical connector assembly includes a housing with a plurality of terminals mounted therein, each terminal adapted to contact one of the conductors.

In a well known connector, each terminal has a U-shaped body section defined by a pair of opposing arms and a solder tail projecting from one end of the U-shaped body section. The ends of the arms are provided with a projecting portion at the free ends thereof. The conductors of the flat flexible cable are received between the projecting portions of the terminals.

Terminals of the type described above are fabricated by punching pre-plated conductive metallic sheets. During the punching process, the plating on the surfaces which are adapted to contact the conductors of the multi-conductor cable are likely to be removed. The points of which the plating is removed, is subject to oxidation and an increase in the contact resistance. This will compromise the electrical connection between the terminal and the cable conductor.

As a result of the above drawback, the terminals have to be replaced periodically. In the alternative, such a terminal would have to be post-plated which is a relatively expensive manufacturing operation.

In order to solve the above problem, terminals of the type described have surfaces which contact the cable conductor which are formed at a certain angle in relative relation to the arms. In this manner the contact surfaces are still plated after forming. However, it becomes difficult to accommodate a wide range of cable conductor thicknesses employing such a design.

SUMMARY OF THE INVENTION

It is, therefore, the principal object of the present invention to provide a new and improved electrical terminal to interface with the conductor of a flat flexible cable wherein the terminal is of such a configuration does not require post-plating by presently only pre-plated surfaces in contact with a cable conductor while simultaneously accommodating a wide range of cable conductor thicknesses.

These and other objects of the present invention are accomplished by providing a conductor assembly including a housing having a plurality of side by side, elongated, open ended terminal receiving cavities formed therein, a slot formed across the open ends of the cavities for receiving the edge of exposed cable conductors therethrough, and a plurality of stamped, formed electrical terminals formed from flat metal conductive material, each terminal having a generally planar, U-shaped terminal body with first and second arms extending up from the base of said body and having a portion extending in the opposite direction from the base for electrical connection to the other circuit member, at least one arm having a contact portion formed near the free end thereof for making an electrical interface with the cable conductor when said cable is received in the housing slot and in the area between the two arms, said terminal further including mounting means cooperating with the housing for securing a terminal therein, The improvement comprises:

the first arm including a hook-shaped engaging portion having the contact surface formed thereon that is disposed substantially vertical to and in a projecting relation from the plane of said first arm at an acute angle relative to the longitudinal axis thereof;

said second arm having a lateral flange portion extending substantially the whole length of said second arm and projecting at a right angle with respect to the plane of said second arm;

each terminal receiving cavity including a terminal supporting portion defining a L-shaped slot immediately adjacent to and transverse to the cable receiving slot;

said flange portion being received on one side of the terminal supporting portion and the hook-shaped engaging portion having its contact surface biased against the other side of said contact supporting portion;

whereby said cable conductor is adapted to be received in the slot so that it is disposed between said contact surface and said contact supporting portion.

BRIEF DESCRIPTION OF THE DRAWINGS

FIG. 1 is a perspective view of a conventional electric terminal known in the prior art;

FIG. 2 is a perspective view of another conventional electric terminal known in the prior art;

FIGS. 3(*a*) and (*b*) are perspective views of the electric terminal according to the present invention;

FIG. 5(*b*) is a side sectional view of FIG. 5(*a*) viewed from the direction A;

FIG. 6 is a side sectional view showing the connector assembly the present invention mounted on a printed circuit board and receiving a multi-conductor flat flexible cable;

FIG. 7 is a plan view of another embodiment of the present invention wherein the terminal has an arcuate contact portion at the forward end of the first arm;

FIG. 8(*a*) is a plan view showing another embodiment of the electric terminal of the present invention with a crimp section;

FIG. 8(*b*) is a plan view of the electric terminal of FIG. 8(*a*) showing a wire crimped onto the terminal;

FIG. 9(*b*) is a perspective view of still another embodiment showing an electric terminal wherein the solder tail portion is provided at either end of the flange portion;

DESCRIPTION OF THE PREFERRED EMBODIMENT

Figure 4:
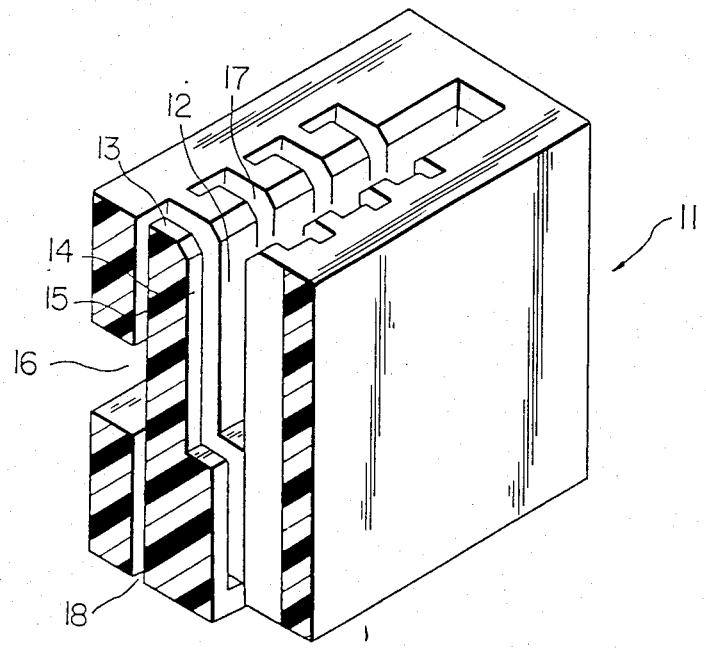
FIG. 4 is a partially sectioned perspective view of the housing for the connector assembly of the present invention.

Turning now to the drawings, FIGS. 1 and 2 illustrate two conventional electric terminals, generally designated 27, which are known in the art. These terminals are used to electrically connect the conductors of a multi-conductor flat flexible cable with another circuit member such as a printed circuit board.

Each of the terminals 27 of FIGS. 1 and 2 generally include a U-shaped body section 127 having a pair of opposing arms 28 and 28′ and a solder tail 31 projecting from one end of the U-shaped body section at its base or bight. Each of the arms 28 and 28′ in FIG. 1 has an inwardly projecting portion 29 and 29′ at the free end thereof. The conductor of the cable is adapted to be clamped between the projecting portions 29 and 29′ at surfaces 30 and 30′ thereof.

The type of terminal 27 shown in FIG. 1 is fabricated by punching a pre-plated conductive metallic sheet. During the punching process, the plating may come off at contact surfaces 30 and 30′ of projecting portions 29 and 29′. If the plating is removed at surfaces and 30 and 30′ oxidation will form at the interface with the conductor and decrease the conductivity thereof. This would degrade the electrical interface.

The terminal showned in FIG. 2 is somewhat of an improvement over that which illustrated in FIG. 1. Terminal 27′ has opposed arms 28 and 28′ having free ends with contact portions 33 and 33′ hooked at a certain angle relative to said arms. The conductor of the cable is clamped between surfaces 34 and 34′ of the contacting portions 33 and 33′. Surfaces 34 and 34′ of contact portions 33 and 33′ can remain plated after the punching process because surfaces 34 and 34′ are not punched surfaces. Therefore, oxidation would not occur at these points.

The terminal 27′ of FIG. 2 has a much larger space between surfaces 34 and 34′ than surfaces 30 and 30′ in terminal 27 shown in FIG. 1. From a manufacturing point-of-view, it is difficult to form projections 33 and 33′ so that surfaces 34 and 34′ are at the correct manufacturing tolerances. There is the further disadvantage of the limitation of the cable conductor size necessary for intimately engaging with surfaces 34 and 34′.

Turning now to FIGS. 3(*a*) and 3(*b*), a terminal made according to the present invention and generally designated 1, is obtained by punching and forming a conductive metal sheet in the form of a U-shaped body section to having first and second arms 3 and 4. Extending downwardly from the base or bight portion of the U-shaped body section 2 is a solder tail 10 for connection to a printed circuit board or the like. Arms 3 and 4 extend upwards from both ends of the base 5.

The first arm 3 converges inwardly at its free end to form a hooked portion 6 which extends to form a slanted contact surface 7 to engage the conductor of a cable. The hooked-portion 6 extends from arm 3 at a substantially right angle relative to the surface of said arm and acute angle relative to the longitudinal axis thereof as seen in the clockwise direction on said plane.

The second arm 4 is provided a flange portion 8 formed perpendicularly to arm 4 along the major length thereof. A central portion of flange portion 8 projects outwardly to form a locking lance 9 for interengagement with an opening 16 of the housing 11 as best seen in FIGS. 4–6.

Although the terminal 1 shown in FIGS. 3(*a*) and 3(*b*) have the solder tail portion at the right and left ends of the bases 5 respectively. It is understood, however, that the solder tail 10 can be provided at the central portion of the base 5.

Figure 5A:
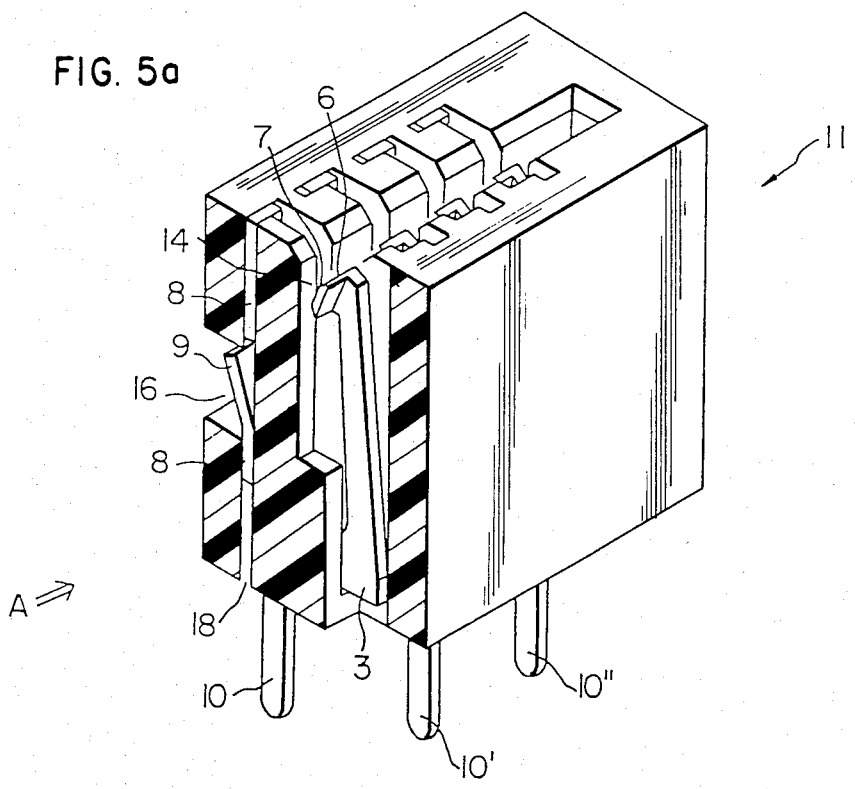
FIG. 5(*a*) is a partially sectioned perspective view of the electric terminal of the present invention mounted in its housing.

Turning now to FIG. 4, the housing 11 is provided with a plurality of open-ended terminal receiving cavities 12 for mounting the terminals 1 therein. Each cavity 12 has the opening 16 for engagement with the locking lance 9 of the terminal. Each cavity 12 also has a forwardly tapered contact support portion 13 which is adapted to be interposed between the contact surfaces 7 and the flange portion 8 of each terminal 1.

Conductor supporting surface 14 is formed on the contact supporting portion 13 so as to elastically clamp the conductor against surface 7. Contact supporting surface also includes an engaging surface 15 which is to be brought into a securely supported relation with flange portion 8 of terminal 1.

Each terminal 1 is mounted within its corresponding cavity 12 through opening 17. The solder tail 10 extends through opening 18 formed at the other end of the cavity 12.

When the terminal 1 is received within housing 11, locking lance 9 engages openings 16 so that the terminal is securely seeded within the housing. This eliminates the possibility of the terminal being disengaged easily from the housing due to external pressure such as shock, vibration, etc.

The hooked portion 6 of terminal 1 is disposed such that contact surface 7 may be biased against the conductor supporting surface of the tapered contact support portion 13. In this configuration the arm 3 is twisted against a housing wall 19 under the elastic action of the arm as best shown in FIG. 5.

The forwardly tapered contact support portion 13 is pressed fitted between the hooked portion 6 of terminal 1 and the flange portion 8 thereof. Thus mounted, the connector assembly can stably and securely electrically connect a plurality of conductors of a multi-conductor flat flexible cable. The terminals 1 can accommodate a wide range of conductor thicknesses.

Looking at FIG. 5*b*, the contact surfaces 7 are biased against the respective conductor supporting surfaces 14 thus providing no space therebetween prior to the insertion of a cable conductor. Because of this preexisting contact, the connector can accommodate an extremely thin conductor therebetween.

Flange portion 8 serves to prevent an electrical interface of insufficient pressure due to the deformation of the plastic tapered contact support portion 13 which may be caused by the ambient heat. This also prevents terminals 1 from being disengaged from the housing 11. This is accomplished by supporting the tapered contact support portion 13 securely via support surface 15 thereof to maintain the conductor clamping function with respect to the hooked contact surface 7 and the convex contact surface 14.

The solder tail 10 and 10' shown in FIGS. 5 and 6 illustrate that said tails are staggered when they extend out of the housing 11. This is because terminals 1 are inserted within the housing 11 in a reverse orientation every other terminal being the same. The staggered configuration allows for closer spacing between terminals 1.

Looking at FIG. 6, a flat flexible cable having a conductor 21 is shown received within the connector assembly. The connector assembly is mounted on a printed circuit board 20 by soldering solder tails 10 and 10' thereto. The conductors are shown clamped between surface 7 and surface 14 as described above.

The particular embodiment shown in FIG. 6 has vertically disposed terminal receiving cavities 12 relative to the printed circuit board 20. However, as will be explained in greater detail hereinafter, the terminal receiving cavities 12 can be in a different dispostion relative to the printed circuit board 20.

Turning now to FIG. 7, an alternative terminal design is illustrated. The terminal shown therein is similar to that shown in FIG. 3 except rather than the slanted flat contact portion 7 the terminal in FIG. 7 has an arcuate portion 22 at the forward end of first arm 2. The arcuately curved surface 23 of portion 22 can reduce the extent in which abrasion is present between the interface of the conductor and the terminal 1. This serves to increase the operational life of the terminal.

The terminals shown in FIGS. 8(*a*) and 8(*b*) are identical to those shown in FIGS. 3(*a*) and 3(*b*) except that rather than a solder tail 10 there is a crimp section 24 extending from the base. Crimp section 24 includes a portion 25 designed to be press fit about the conductor of a stripped insulated wire and an insulation gripping portion 26.

Figure 9A:
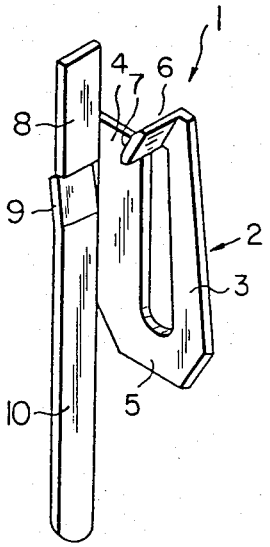
FIG. 9(*a*) is a perspective view of another embodiment of an electric terminal made according to the invention wherein the solder tail portion is provided at the other end of the flange portion.
Figure 9B:
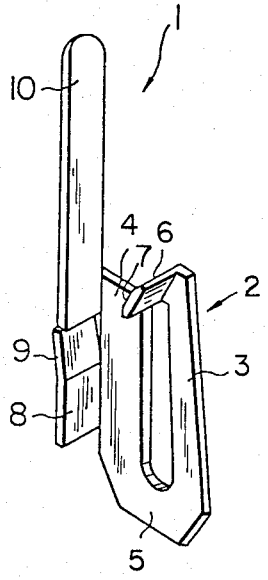
Figure 11:
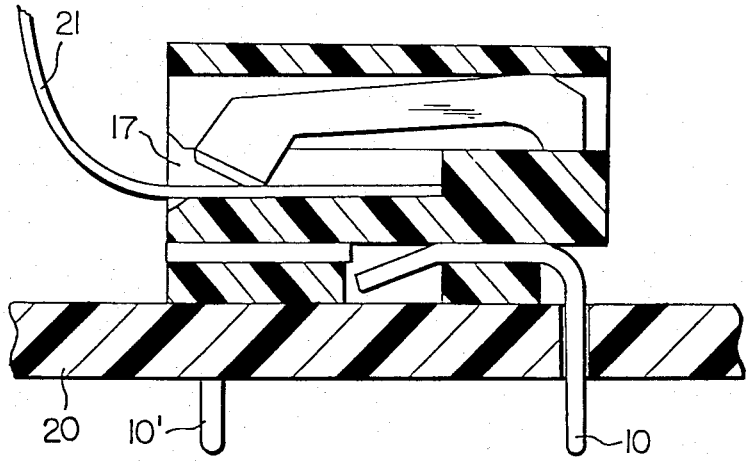
FIG. 11 is a side sectional view showing the connector assembly of FIG. 10 mounted on a printed circuit board and receiving a flat flexible cable therein.

The terminals shown in FIGS. 9(*a*) and 9(*b*) are adapted for use in housings having terminal receiving cavities that are generally parallel to the printed circuit board 20 as best shown in FIG. 11. In particular, the terminals 1 have a solder tail 10 at either end of the flange portion 8. FIG. 9(*a*) is an embodiment wherein the solder tail 10 projects from one end of flange portion 8 near the base portion 5 in a direction opposite to the free end of second arm 4. FIG. 9(*b*) is an embodiment wherein the solder tail 10 projects from the other end of flange portion 8 which extends beyond the forward end of the second arm 4 in the same direction relative to the free end thereof. The reference numerals shown in FIGS. 9(*a*) and 9(*b*) are identical but those in FIG. 3(*a*) and 3(*b*) each referring to the same part. The explanation of each part is omitted.

Figure 10:
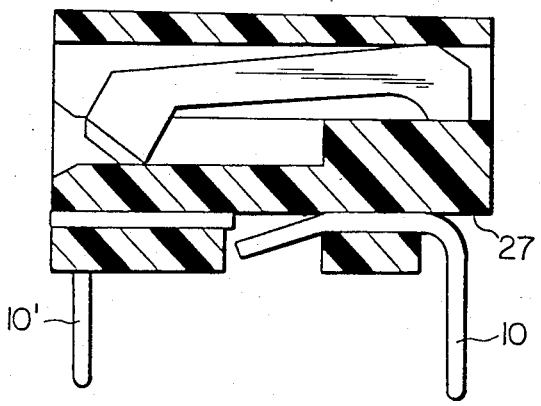
FIG. 10 is a side sectional view of an alternative embodiment of the a connector assembly of the present invention having the terminals of FIGS. 9*a* and 9*b* received in the housing.

The terminals of FIGS. 9(*a*) and 9(*b*) are alternately mounted in every other terminal receiving cavity of the housing. The solder tails 10 and 10' are bent at right angles relative to the bottom wall 27 so that they may be soldered to the printed circuit board 20 as best shown in FIGS. 10 and 11.

When using the connector assembly as shown in FIG. 11, the cable can be connected to the connector parallel to the printed circuit board 20. This configuration, the connector assembly presents a low space saving profile which is advantageous in many applications.

I claim:

1. A connector assembly for electrically connecting the conductors of a flat flexible multi-conductor cable to another circuit member, said connector assembly including a housing having a plurality of side by side, elongated, open ended terminal receiving cavities formed therein, a slot formed across the open ends of the cavities for receiving the edge of exposed cable conductors therethrough, and a plurality of stamped, formed electrical terminals formed from flat metal conductive material, each terminal having a generally planar, U-shaped terminal body with first and second arms extending up from the base of said body and having a portion extending in the opposite direction from the base for electrical connection to the other circuit member, at least one arm having a contact surface formed near the free end thereof for making an electrical interface with the cable conductor when said cable is received in the housing slot and in the area between the two arms, said terminal further including mounting means cooperating with the housing for securing a terminal therein, the improvement comprising:

the first arm including a hook-shaped engaging portion having the contact surface formed thereon that is disposed substantially vertical to and in a projecting relation from the plane of said first arm at an acute angle relative to the longitudinal axis thereof;

said second arm having a lateral flange portion extending substantially the whole length of said second arm and projecting at a right angle with respect to the plane of said second arm;

each terminal receiving cavity including a terminal supporting portion defining a L-shaped slot immediately adjacent to and transverse to the cable receiving slot;

said flange portion being received on one side of the terminal supporting portion and the hook-shaped engaging portion having its contact surface biased against the other side of said contact supporting portion;

whereby said cable conductor is adapted to be received in the slot so that it is disposed between said contact surface and said contact supporting portion.

2. The connector assembly of claim 1 wherein the mounting means includes a projecting locking lance on said flange portion adapted to be received within an opening in the side of the housing for securing the terminal within its respective terminal receiving cavity.

3. The connector assembly of claim 1 wherein said portion connecting the other circuit member is a solder tail.

4. The connector assembly of claim 1 wherein the portion electrically connected to the other circuit member is a crimp section adapted to receive a stripped wire lead.

5. The connector assembly of claim 1 wherein the portion which electrically connected to the other circuit member is on one end of the base or the other so that said portions are staggered when extending from the housing.

6. The connector assembly of claim 1 wherein the contact surface comprises an arcuately curved surface.

7. The connector assembly of claim 1 wherein said second arm is elongated and the portion which is electrically connected to the other circuit member is a solder tail extending in either axial direction from the second arm, said two different kinds of solder tails being mounted in every other terminal receiving cavity, whereby said solder tails extend from both ends of the housing, said solder tails being bent in the same direction in order to provide a connector assembly whose cable receiving slot is generally parallel to a printed circuit board.

* * * * *